United States Patent [19]

Asano et al.

[11] Patent Number: 4,484,999

[45] Date of Patent: Nov. 27, 1984

[54] ELECTROLYTIC ELECTRODES HAVING HIGH DURABILITY

[75] Inventors: Hiroshi Asano, Chiba; Takayuki Shimamune, Tokyo; Hideo Nitta; Ryuta Hirayama, both of Kanagawa, all of Japan

[73] Assignee: Permelec Electrode Ltd., Kanagawa, Japan

[21] Appl. No.: 521,764

[22] Filed: Aug. 9, 1983

[30] Foreign Application Priority Data

Aug. 26, 1982 [JP] Japan ..... 57-146939

[51] Int. Cl.[3] ..... G25B 11/08

[52] U.S. Cl. ..... 204/290 R; 204/290 F; 204/291

[58] Field of Search ..... 204/290 R, 290 F, 291

[56] References Cited

U.S. PATENT DOCUMENTS 3,950,240 4/1976 Cookfair et al. ..... 204/290 F 4,212,725 7/1980 Habermann et al. ..... 204/290 F

FOREIGN PATENT DOCUMENTS 1206863 9/1970 United Kingdom ..... 427/126.3

*Primary Examiner*—T. Tung

*Assistant Examiner*—Terryence Chapman

*Attorney, Agent, or Firm*—Sughrue, Mion, Zinn, Macpeak, and Seas

[57] ABSTRACT

An electrolytic electrode which exhibits high durability when used in electrolysis in which the generation of oxygen is involved and a process for the production of same. The electrolytic electrode comprises (a) an electrode substrate of an electrically-conductive metal; (b) an electrode coating of an electrode active substance; and (c) an intermediate layer provided between the electrode substrate and the electrode coating, said intermediate layer comprising a mixed oxide of (i) an oxide of Ti and/or Sn having a valence number of 4 and (ii) an oxide of Ta and/or Nb having a valence number of 5.

5 Claims, No Drawings

ELECTROLYTIC ELECTRODES HAVING HIGH DURABILITY

FIELD OF THE INVENTION

The present invention relates to electrodes for electrolysis (hereinafter referred to as "electrolytic electrodes") and a process for the production of same. More particularly, the present invention relates to electrolytic electrodes showing high durability, i.e. a long service life, when used in electrolysis of, e.g., an aqueous solution in which the generation of oxygen at the anode is involved, and a process for the production of same.

BACKGROUND OF THE INVENTION

Heretofore, electrolytic electrodes comprising a substrate of valve metals, e.g., titanium (Ti), have been used as superior insoluble metal electrodes in the field of electrochemistry. In particular, they have been widely used as anodes for the generation of chlorine in the salt (sodium chloride) electrolytic industry. In addition to Ti, tantalum (Ta), niobium (Nb), zirconium (Zr), hafnium (Hf), vanadium (V), molybdenum (Mo), tungsten (W), etc. are known as valve metals.

These metal electrodes are produced by coating metallic titanium with various electrochemically active substances such as platinum group metals and their oxides. Examples of such platinum group metals and their oxides are described in, e.g., U.S. Pat. Nos. 3,632,498 and 3,711,385. As electrodes for the generation of chlorine, these electrodes can maintain a low chlorine overvoltage over a long period of time.

However, when the above metal electrodes are used as anodes in electrolysis for the generation of oxygen or electrolysis in which the generation of oxygen is involved, the anode overvoltage gradually increases. In extreme cases, the anode is passivated and thus it becomes impossible to continue the electrolysis.

The phenomenon of passivation of the anode is believed to be caused mainly by the formation of electrically non-conductive titanium oxides that result from (1) the oxidation of the titanium base material with oxygen by the electrode coating-constituting oxide substances itself; (2) oxygen diffusion-permeating through the electrode coating; or (3) an electrolyte.

Formation of such electrically non-conductive oxides in the interface between the base material and the electrode coating causes the electrode coating to peel off. This creates problems such as the breakdown of the electrode.

Electrolytic processes in which the anode product is oxygen, or oxygen is generated at the anode as a side reaction, include: (1) electrolysis using a sulfuric acid bath, a nitric acid bath, an alkali bath or the like; (2) electrolytic separation of chromium (Cr), copper (Cu), zinc (Zn), or the like; (3) various types of electroplating; (4) electrolysis of dilute salt water, sea water, hydrochloric acid, or the like; and (5) electrolysis for the production of chlorate, and so forth. These processes are all industrially important. However, the above-described problems have hindered the metal electrodes from being used in these processes.

U.S. Pat. No. 3,775,284 has disclosed a technique to overcome passivation of the electrode due to permeation of oxygen. In this technique, a barrier layer of a platinum (Pt)-iridium (Ir) alloy, or oxides of cobalt (Co), manganese (Mn), lead (Pb), palladium (Pd), and Pt is provided between the electrically-conductive substrate and the electrode coating.

The substances constituting the intermediate barrier layer can prevent the diffusion-permeation of oxygen during electrolysis to some extent. However, these substances are electrochemically very active and therefore, react with an electrolyte coming through the electrode coating. This produces electrolytic products, e.g., gas, on the surface of the intermediate barrier layer which gives rise to additional problems. For example, the adhesion of the electrode coating is deteriorated under the physical and chemical influences of the electrolytic products. Thus, there is the danger of the electrode coating peeling off before the life of the substance constituting the electrode coating has expired. Another problem is that the corrosion resistance of the resulting electrodes is poor. Thus, the method proposed in U.S. Pat. No. 3,775,284 fails to produce electrolytic electrodes which are of high durability.

U.S. Pat. No. 3,773,555 discloses an electrode in which a layer of an oxide of, e.g., Ti, and a layer of a platinum group metal or its oxide are laminated and coated on the electrode. However, this electrode suffers from the problem that when it is used in electrolysis in which the generation of oxygen is involved, passivation occurs.

SUMMARY OF THE INVENTION

The present invention is intended to overcome the above-described problems. More specifically, an object of the present invention is to provide electrolytic electrodes which are especially suitable for use in electrolysis in which the generation of oxygen is involved, i.e., which are resistant to passivation and are of high durability.

Another object of the present invention is to provide a process for producing such electrolytic electrodes.

The above described objects have been met by:

(1) An electrolytic electrode comprising (a) an electrode substrate of an electrically-conductive metal; (b) an electrode coating of an electrode active substance; and (c) an intermediate layer provided between the electrode substrate and the electrode coating, wherein said intermediate layer comprising a mixture of (i) an oxide of at least one member selected from the group consisting of titanium (Ti) and tin (Sn), each having a valence number of 4, and (ii) an oxide of at least one member selected from the group consisting of tantalum (Ta) and nobium (Nb), each having a valence number of 5; and (2) a process for producing an electrolytic electrode which comprises (a) coating an electrically-conductive mixed oxide comprising a mixture of an oxide of Ti and/or Sn and an oxide of Ta and/or Nb on an electrode substrate of an electrically-conductive metal by a thermal decomposition method to form an intermediate layer and, thereafter, (b) coating an electrode active substance on the intermediate layer.

DETAILED DESCRIPTION OF THE INVENTION

The present invention is based on the new findings that the provision of the intermediate layer between the substrate and the electrode coating enables one to obtain an electrode which can be used with sufficient durability as an anode for electrolysis in which the generation of oxygen is involved.

The intermediate layer of the present invention is corrosion-resistant and is electrochemically inactive. A function of the intermediate layer is to protect the electrode substrate, e.g., Ti, so as to prevent passivation of the electrode without reducing its electrical conductivity. At the same time, the intermediate layer acts to enhance the adhesion or bonding between the base material and the electrode coating.

Accordingly, the present invention provides electrolytic electrodes which have sufficient durability when used in electrolysis for the generation of oxygen or electrolysis in which oxygen is generated as a side reaction. Such processes have heretofore been considered difficult to perform with conventional electrodes.

The present invention will be explained in greater detail below.

In the production of the electrode substrate of the present invention, corrosion-resistant, electrically-conductive metals, e.g., Ti, Ta, Nb, and Zr, and their base alloys can be used. Suitable examples are metallic Ti, and Ti-base alloys, e.g., Ti—Ta—Nb and Ti—Pd, which have heretofore been commonly used. The electrode base material can be in any suitable form such as in the form of a plate, a perforated plate, a rod, or a net-like member.

The intermediate layer is provided on the above-described electrode substrate and comprises a mixed oxide of an oxide of Ti and/or Sn having a valence number of 4 and an oxide of Ta and/or Nb having a valence number of 5.

An electrolytic electrode comprising an electrode substrate of Ti or a Ti-base alloy and an electrode coating of a metal oxide, wherein a thin intermediate layer of an electrically-conductive oxide of Ta and/or Nb is provided between the substrate and the coating, to provide electrical conductivity to the Ti oxides being formed on the surface of the substrate, has already been developed and filed as U.S. patent application Ser. No. 379,699 filed on May 19, 1982. This electrode is resistant against passivation and has superior durability. However, in this electrode, the Ti oxides that are formed in small amounts on the surface of the Ti substrate are made electrically-conductive by means of the intermediate layer substance. Thus, it is necessary to greatly reduce the thickness of the intermediate layer. Hence, the possibility of further increasing the durability of the electrode by an intermediate layer of sufficient thickness is limited.

In accordance with the present invention, an electrode of higher durability can be produced without the above-described limitation even if the intermediate layer is made of those substances which per se have sufficient electrical conductivity.

It has been found that the mixed oxide of the oxide of Ti and/or Sn and the oxide of Ta and/or Nb are suitable for use as the intermediate layer substance and produce excellent effects. These intermediate layer substances have superior corrosion resistance, are electrochemically inactive, and are of sufficient electrical conductivity. The intermediate layer substances used in the present invention also include those metal oxides which have non-stoichiometric or lattice defects and are represented as $TiO_2$, $SnO_2$, $Ta_2O_5$, $Nb_2O_5$, etc. for the sake of convenience.

The intermediate layer substances of the present invention are combinations of the oxides of metals (Ti and Sn) having a valence number of 4 and the oxides of metals (Ta and Nb) having a valence number of 5. Any of $TiO_2$—$Ta_2O_5$, $TiO_2$—$Nb_2O_5$, $SnO_2$—$Ta_2O_5$, $SnO_2$—$Nb_2O_5$, $TiO_2$—$SnO_2$—$Ta_2O_5$, $TiO_2$—$SnO_2$—$Nb_2O_5$, $TiO_2$—$Ta_2O_5$—$Nb_2O_5$, $SnO_2$—$Ta_2O_5$—$Nb_2O_5$, and $TiO_2$—$SnO_2$—$Ta_2O_5$—$Nb_2O_5$ can be used in the present invention.

The ratio of the Ti and/or Sn oxide to the Ta and/or Nb oxide is not critical and can be chosen within a broad range. In view of the durability and electrical conductivity of the electrode, it is preferred that the molar ratio of the Ti and/or Sn oxide to the Ta and/or Nb oxide is from 95:5 to 10:90.

The intermediate layer can be formed by any desired technique as long as a uniform and dense coating of the electrically-conductive mixed oxide can be obtained. A suitable technique is a thermal decomposition method in which a mixed solution containing salts, e.g., chlorides, of Ti and/or Sn and Ta and/or Nb is coated on a base material and converted into the corresponding mixed oxide by heating in an oxidizing atmosphere.

The amount of the intermediate layer substance being coated is preferably within the range of from $0.1\times10^{-2}$ to $10\times10^{-2}$ mol/m$^2$ (calculated as metal). Outside of this range, no sufficient results can be obtained.

The thus-formed intermediate layer is then coated with an electrode active substance which is electrochemically active to produce the desired product. Suitable examples of such electrode active substances are metals, metal oxides or mixtures thereof, which have superior electrochemical characteristics and durability. The type of the active substance can be determined appropriately depending on the electrolytic reaction in which the electrode is to be used. Active substances particularly suitable for the above-described electrolytic processes in which the generation of oxygen is involved include: platinum group metal oxides, and mixed oxides of platinum group metal oxides and valve metal oxides. Typical examples include: Ir oxide, Ir oxide-Ru oxide, Ir oxide-Ti oxide, Ir oxide-Ta oxide, Ru oxide-Ti oxide, Ir oxide-Ru oxide-Ta oxide, and Ru oxide-Ir oxide-Ti oxide.

The electrode coating can be formed in any suitable manner, e.g., by thermal decomposition, electrochemical oxidation, or powder sintering. A particularly suitable technique is the thermal decomposition method as described in detail in U.S. Pat. Nos. 3,711,385 and 3,632,498.

The exact reason why the provision of the intermediate layer, consisting of the mixed oxide of 4-valent and 5-valent metals, between the metal electrode substrate and the electrode active coating produces the above-described results is not well understood, however, the reason is believed to be as follows:

Since the metal surface of the substrate is covered with the dense metal mixed oxide intermediate layer and protected from oxidation, the passivation of the substrate is prevented. In the intermediate layer, the 4-valent and 5-valent metals are present simultaneously as oxides. Therefore, according to the generally known principle of Controlled Valency, the intermediate layer becomes an N-type semi-conductor having very high electrical conductivity. Moreover, where metallic Ti, for example, is used as a substrate, even when electrically non-conductive Ti oxides are formed on the surface of the substrate during the production of the electrode or during the use of the electrode in electrolysis, the 5-valent metal in the intermediate layer diffuses and makes the Ti oxides semi-conductors. Accordingly, the electrical conductivity of the electrode is maintained and passivation is prevented.

In addition, the intermediate layer substance enhances the adhesion or bonding between the substrate of, e.g., metallic Ti, and the electrode active coating of, e.g., platinum group metal oxides and valve metal oxides, and hence increases the durability of the electrode.

The present invention is described in greater detail by reference to the following examples which are in no way intended to limit the present invention.

EXAMPLE 1

A commercially available Ti plate having a thickness of 1.5 mm was degreased with acetone. Thereafter, the plate was subjected to an etching treatment using a 20% aqueous hydrochloric acid solution maintained at 105° C. The thus treated Ti plate was used as an electrode substrate.

A 10% hydrochloric acid mixed solution of tantalum chloride, containing 10 g/l of Ta, and titanium chloride containing 10.4 g/l of Ti, was coated on the Ti plate and dried. Thereafter, the plate was heated for 10 minutes in a muffle furnace maintained at 450° C. This procedure was repeated twice to form an intermediate layer of a $1.0\times10^{-2}$ mol/m$^2$ $TiO_2$—$Ta_2O_5$ mixed oxide (molar ratio of Ti to Ta=80:20) on the Ti substrate.

A butanol solution of iridium chloride containing 50 g/l of Ir was coated on the above-formed intermediate layer and heated for 10 minutes in a muffle furnace maintained at 500° C. This procedure was repeated three times to produce an electrode with Ir oxide, containing 30 g/m$^2$ of Ir, as an electrode active substance.

With the thus-produced electrode as an anode and a graphite plate as a cathode, accelerated electrolytic testing was performed in a 150 g/l sulfuric acid electrolyte at 60° C. and a current density of 100 A/dm$^2$. The results demonstrated that this electrode could be used stably for 160 hours.

For comparison, an electrode was produced in the same manner as above except that the intermediate layer was not provided. This electrode was also tested in the same manner as above. The results demonstrated that this electrode was passivated in 26 hours and could no longer be used.

EXAMPLE 2

An electrode was produced in the same manner as in Example 1 except that an intermediate layer of a $TiO_2$—$Nb_2O_5$ mixed oxide (molar ratio of Ti to Nb=80:20) was provided. The thus-produced electrode was tested in the same manner as in Example 1. The results demonstrated that this electrode could be used for longer than 76 hours.

EXAMPLE 3

Three electrodes as described in Table 1 were produced in the same manner as in Example 1. These electrodes were subjected to accelerated electrolytic testing. The accelerated electrolytic testing was performed in a 12N aqueous NaOH solution at 95° C. and a current density of 250 A/dm$^2$. The results are shown in Table 1.

TABLE 1

| Run No. | Substrate | Intermediate Layer | Electrode Active Substance | Life (Hrs) |
|---|---|---|---|---|
| 1 | Ti | $TiO_2$—$SnO_2$—$Ta_2O_5$ (20:60:20) | $RuO_2$—$IrO_2$ (50:50) | 14 |
| 2 | Ti | $SnO_2$—$Ta_2O_5$ (82:18) | $RuO_2$—$IrO_2$ (50:50) | 10 |
| 3* | Ti | — | $RuO_2$—$IrO_2$ (50:50) | 3 |

*Comparative example

It can be seen from Table 1 that the electrodes with the intermediate layer provided thereon according to the present invention are superior in durability and thus service life, to the comparative electrode having no intermediate layer provided thereon.

While the invention has been described in detail and with reference to specific embodiments thereof, it will be apparent to one skilled in the art that changes and modifications can be made therein without departing from the spirit and scope thereof.

We claim:

1. An electrolytic electrode comprising (a) an electrode substrate of an electrically-conductive metal; (b) an electrode coating of an electrode active substance; and (c) an intermediate layer provided between said electrode substrate and said electrode coating, said intermediate layer comprising a mixed oxide of (i) an oxide of at least one member selected from the group consisting of titanium (Ti) and tin (Sn), both having a valence number of 4, and (ii) an oxide of tantalum (Ta) having a valence number of 5.

2. The electrode as claimed in claim 1, wherein the electrically-conductive metal is at least one member selected from the group consisting of titanium, tantalum, niobium, zirconium and their base alloys.

3. The electrode as claimed in claim 1, wherein the molar ratio of the Ti and/or Sn oxide to the Ta is 95:5 to 10:90.

4. The electrode as claimed in claim 1, wherein the mixed oxide of the intermediate layer is coated on the electrode substrate in an amount of from $0.1\times10^{-2}$ to $10\times10^{-2}$ mol/m$^2$.

5. The electrode as claimed in claim 1, wherein the electrode active substance is selected from the group consisting of a platinum group metal oxide and a mixed oxide of a platinum group metal oxide and a valve metal oxide.

* * * * *